US006828915B2

(12) United States Patent
Gottlieb

(10) Patent No.: US 6,828,915 B2
(45) Date of Patent: Dec. 7, 2004

(54) CIRCUIT BOARD FAULT WARNING SYSTEM

(75) Inventor: Gary Gottlieb, Irvine, CA (US)

(73) Assignee: ADC DSL Systems, Inc., Eden Prairie, MN (US)

( * ) Notice: Subject to any disclaimer, the term of this patent is extended or adjusted under 35 U.S.C. 154(b) by 201 days.

(21) Appl. No.: 10/051,794

(22) Filed: Jan. 16, 2002

(65) Prior Publication Data

US 2003/0132851 A1 Jul. 17, 2003

(51) Int. Cl.[7] ..... G08B 21/00

(52) U.S. Cl. ..... 340/653; 340/636.12; 340/636.13; 340/641; 340/654; 340/815.45; 340/691.1; 340/656; 340/660; 361/42; 361/93.2; 361/45; 361/71; 361/78

(58) Field of Search ..... 340/653, 636.12, 340/636.13, 641, 654, 815.45, 691.1, 650, 660; 361/42, 93.2, 45, 71, 78

(56) References Cited

U.S. PATENT DOCUMENTS 4,506,218 A * 3/1985 Brown et al. ..... 324/772
4,688,021 A * 8/1987 Buck et al. ..... 340/521
4,769,621 A * 9/1988 Kipnis ..... 331/117 R
4,901,461 A * 2/1990 Edwards et al. ..... 40/575
5,469,157 A * 11/1995 Carpenter et al. ..... 340/908.1
5,557,300 A * 9/1996 Satoh ..... 345/170

* cited by examiner

*Primary Examiner*—Daniel J. Wu
*Assistant Examiner*—Tai T. Nguyen
(74) *Attorney, Agent, or Firm*—Fogg and Associates, LLC; Laura A. Ryan

(57) ABSTRACT

A fault warning system controls light sources and a warning signal to provide an indication of fatal and non-fatal faults in a communication system. The circuitry uses a pull-down circuit in electrical communication with light and signal control circuits. The circuit can be operated to activate a first light emitting diode (LED) if an operational status of a monitored circuit is either fatal or non-fatal fault. The circuit can be operated to deactivate a second LED if an operational status of a monitored circuit is fatal, and the second LED remains active if the operational status of the circuit is a non-fatal fault.

13 Claims, 2 Drawing Sheets

CIRCUIT BOARD FAULT WARNING SYSTEM

FIELD OF THE INVENTION

The present invention relates generally to communication equipment and in particular the present invention relates to fault notification circuitry.

BACKGROUND OF THE INVENTION

Communication equipment such as voice or data communication equipment includes hardware components. These hardware components are susceptible to faults and interruptions in operation. For example, cards (circuit boards) used to process or route signals may suffer a complete power interrupt and cease operation. The interruption can result in a system-wide failure that must be corrected. Troubleshooting the system failure can be greatly assisted if the hardware provides an indication of the failure. Numerous cards are often mounted in a rack and are coupled to communication lines. The cards are typically coupled to a processor card (management processor) managing this and other cards for quality of operation. If there is an interruption with a line, a technician needs to be able to determine if there is a problem with the card or a remote problem with the line. Both the technician and the management processor need to be notified of card faults. As such, visual and electronic indicators are often provided.

One method of providing an indication of circuit board failure uses a relay to trigger a warning circuit. The relay can be either mechanical or optical. The warning circuitry can provide a visual indication of failure by illuminating, for instance, one or more light-emitting diodes (LED). The warning circuitry can also provide an error signal that notifies the system processor of the card failure.

Problems with these system-troubleshooting circuits include relatively high cost and power consumption. For the reasons stated above, and for other reasons stated below which will become apparent to those skilled in the art upon reading and understanding the present specification, there is a need in the art for new circuitry to indicate circuit faults and failures.

SUMMARY OF THE INVENTION

The above-mentioned problems with fault warning circuitry and other problems are addressed by the present invention and will be understood by reading and studying the following specification.

In one embodiment, a fault indication circuit comprises a light emitting diode (LED), a first transistor coupled in series with the LED to control current flow through the LED, and a second transistor electrically coupled to the first transistor to selectively activate the first transistor in response to a signal provided by an external circuit board. The second transistor maintains the first transistor in a deactivated state while the circuit board is operational.

In another embodiment, a circuit board fault indicator comprises a LED having an anode coupled to an upper supply voltage node via a first resistor, a first transistor coupled between a cathode of the LED and a lower supply voltage node, and a second transistor electrically coupled to a control node of the first transistor to selectively activate the first transistor in response to a signal provided by an external circuit board. A third transistor is coupled between the cathode of the LED and the lower supply voltage node. A control node of the third transistor is coupled to receive a non-fatal fault signal provided by the external circuit board. A fourth transistor is coupled between a signal output node and the lower supply voltage node. In one embodiment a second LED is coupled to be illuminated when the first transistor is inactive.

A method of indicating faults in a communication system monitors an operational status of a circuit and activates a first light emitting diode (LED) if the operational status of the circuit is non-functional.

A method of indicating faults in a communication system monitors an operational status of a circuit and deactivates a second LED if the operational status of the circuit is non-functional. The first LED is activated while the second LED remains active if the operational status of the circuit is a minor fault.

DETAILED DESCRIPTION OF THE DRAWINGS

In the following detailed description of the preferred embodiments, reference is made to the accompanying drawings, which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims.

Figure 1:
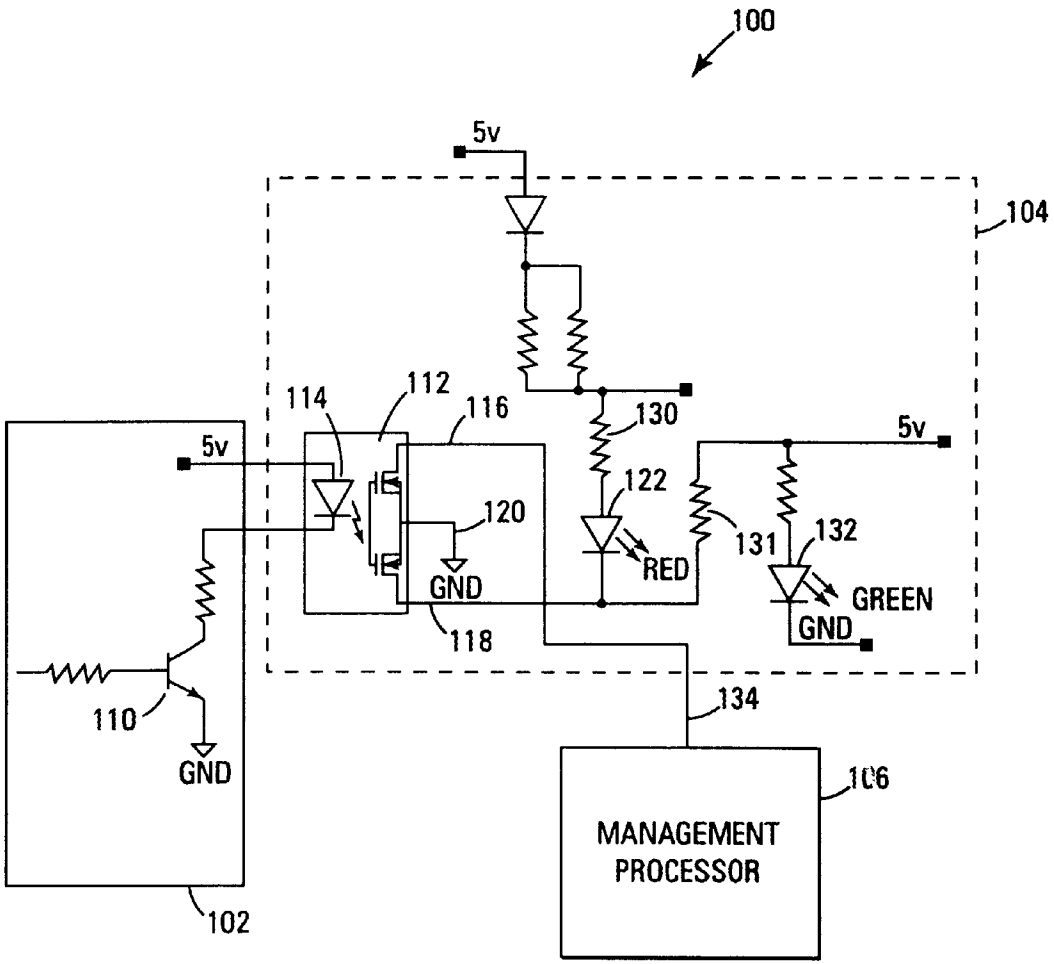
Fig. 1 Prior Art
FIG. 1 is a schematic diagram of a prior art warning system.

Referring to FIG. 1, a prior art fault warning circuit 100 is described. The circuitry is provided in a system that includes a circuit board 102, support circuitry 104 and a processor 106. The circuit board can be part of a voice/data communication system. The circuit board includes a pull-down transistor 110 coupled to a dual optical relay 112. While the circuit board is functioning properly (no failure), the LED 114 is activated and isolates the outputs 116 and 118 of the relay from the ground connection 120. As such, a first LED (red color) 122 is not activated because its cathode is coupled through a resistor(s) 131 to a positive supply. A second LED (green color) 132 is activated. A management processor warning signal on node 134 is floating while the circuit board is functional.

When the circuit board 102 suffers a failure, the pull-down transistor 110 is turned off and the dual optical relay 112 couples the outputs 116 and 118 to ground. The green LED 132 may be turned off when the supply becomes inactive. The red LED 122 is activated by coupling its cathode to ground. As such, the circuitry 100 provides a visual indication that a failure has occurred. The warning signal 134 is coupled to ground by the relay to provide a notification to the management processor that the circuit board has failed.

The above-described warning system requires that the dual relay be operating all the time when the circuit board is functional. This consumes power and the relay is a relatively expensive component. Further, the system does not allow for a warning when there is a minor fault with the circuit board operation that does not result in a circuit board power failure.

Figure 2:
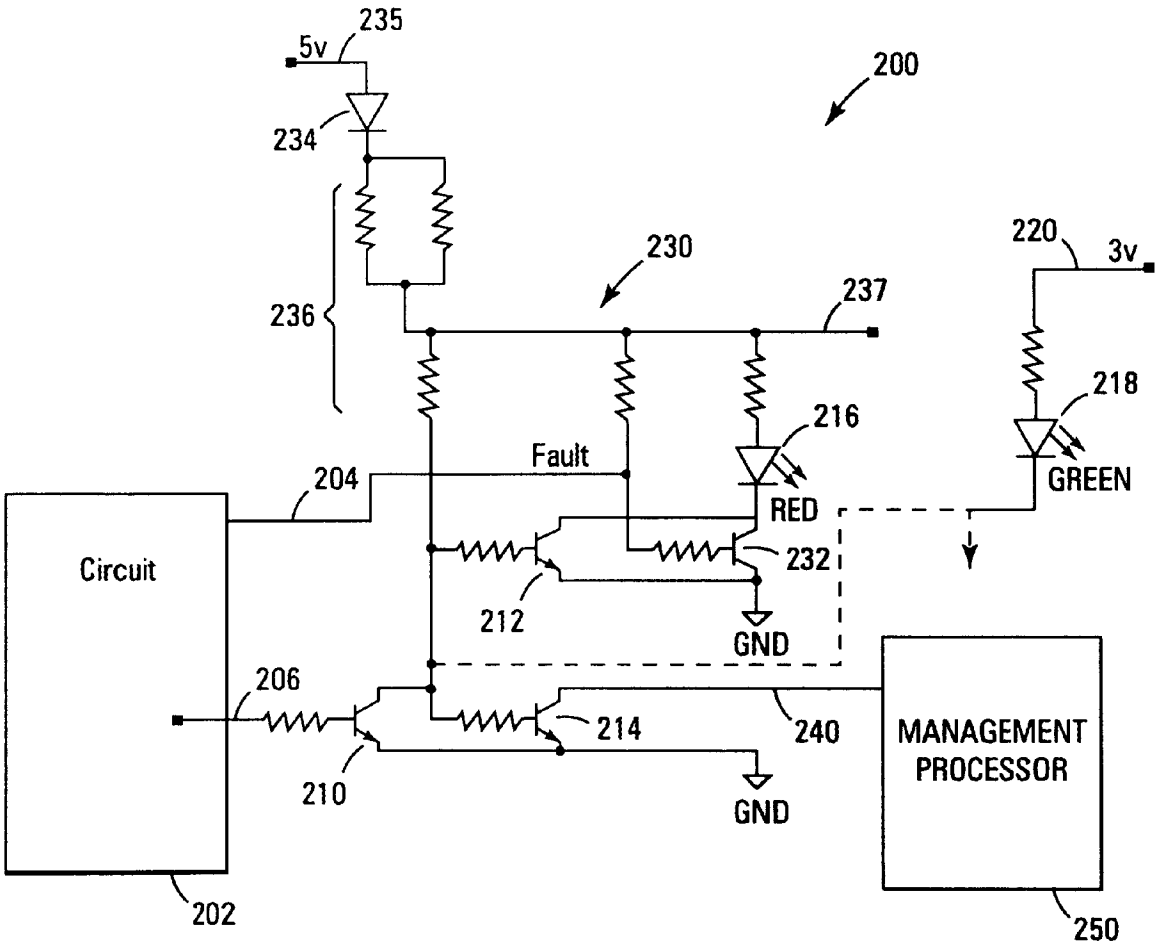
FIG. 2 is a schematic diagram of a warning system of an embodiment of the present invention.

Referring to FIG. 2, a schematic diagram of a warning, or 'deadman', circuit 200 of one embodiment of the present invention is described. The circuit can be coupled to any circuit or circuit board 202 to provide visual and electronic indications of fault or failure condition. The warning circuitry does not use a relay circuit, but uses two signals from the circuit board to generate the fault indications. In one embodiment the circuit board is a DSL line card used in the telecommunication industry. The line card is housed in a rack for communicating via DSL lines. The warning circuitry can be provided on the card or on the rack. In one embodiment, the card provided two signals to the warning circuitry which is located within the rack, as described below.

Two output signals 204 and 206 are provided by the circuit board. The first output 204 is a non-fatal (minor) fault signal that is normally low and transitions to a high state when an operating error is detected. The second output 206 is a 'deadman' signal that is normally high and transitions low when the circuit board suffers a fatal fault, such as no-power.

The 'deadman' signal 206 is coupled to control a pull-down transistor 210. The pull-down transistor in turn keeps transistors 212 and 214 turned off. As such, an alarm signal provided by transistor 214 floats when the circuit board is operational. A first LED (color red) 216 coupled to transistors is not conducting current when transistors are turned off.

A second LED (color green) 218, if used on the circuit board, is coupled to remain active when the circuit board is powered. That is, the anode of the LED 218 is coupled to a power supply connection 220 from circuit board 202. If the circuit board has a loss of power, the LED will turn off. Alternatively, the cathode of the LED can be coupled to the pull-down transistor 210 (dashed line) in place of a ground connection.

Pull-up circuitry 230 is coupled to bias the red LED 216 and the control nodes of transistors 212 and 232. The pull-up circuitry can be powered by a supply 235, such as 5 volts, from circuit board 202 through a diode 234 and current limiting resistors 236. Supply 235 can be provided from circuit board 202. During normal operation, pull-down transistor 210 shorts the pull-up circuitry to a low voltage. When the circuit board has a fatal fault, the 'deadman' signal goes low and transistor 210 is turned off. In response, transistor 212 is activated to turn the first LED 216 on. Node 237 can be coupled to other common circuits to source a supply voltage to the first LED 216 in case circuit board 202 looses power. The warning signal coupled to a management processor 250 on node 240 is pulled low through activated transistor 214. The green LED 218, when used on the circuit board, likewise, is turned off when the circuit board looses power.

When the circuit board suffers a non-fatal (minor) fault, the fault signal 204 goes high to activate transistor 232, which, in turn, couples the cathode of LED 216 low. As such, both the red and green LEDs are illuminated. The management processor warning signal 240 is not activated when a non-fatal fault is detected.

The above-described embodiment does not use an optical coupled relay to control the warning lights and signal. In contrast, the circuit board signals selectively activate/deactivate transistors that are electrically coupled to the lights and signal transistor. The transistors can be bi-polar junction transistors (BJT) or field effect transistors (FET), or the like. In the illustrated embodiment the transistors are NPN bipolar junction transistors.

CONCLUSION

A method of indicating faults in a communication system has been described. The method monitors an operational status of a circuit and activates a first light emitting diode (LED) if the operational status of the circuit is non-functional. The method monitors an operational status of a circuit and deactivates a second LED if the operational status of the circuit is non-functional. The first LED is activated if the operational status of the circuit is a functional fault, while the second LED remains active if the operational status of the circuit is a functional fault.

A fault warning circuit has also been described to that is coupled to a circuit board and a management processor. The fault warning circuit includes a first light emitting diode (LED) and a pull-up circuit coupled to the first LED to bias an anode of the first LED to an upper supply. A pull-down circuit is coupled to the first LED to bias a cathode of the first LED to a lower supply. The pull-down circuit includes transistors coupled in series with the first LED to selectively activate the LED in response to a signal provided by the circuit board. The pull-down circuit can optionally activate the LED in response to a non-fatal (minor) fault signal provided by the circuit board.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A fault indication circuit comprising:

a light emitting diode (LED);

a first transistor coupled in series with the LED to control current flow through the LED;

a second transistor electrically coupled to the first transistor to selectively activate the first transistor in response to a signal provided by an external circuit, wherein the second transistor maintains the first transistor in a deactivated state while the circuit is operational; and a third transistor coupled in series with the LED, and parallel to the first transistor, to control current flow through the LED in response to a non-fatal fault signal provided by the external circuit.

2. The fault indication circuit of claim 1 further comprising a pull-up circuit coupled to a control node of the first transistor, and wherein the second transistor is a pull-down transistor coupled to the control node of the first transistor.

3. The fault indication circuit of claim 1 further comprising a second LED coupled to be illuminated when the first transistor is inactive.

4. A communication system comprising:

a circuit board having a first output signal indicating when the circuit board is operational, and a second output signal indicating if an operational fault has been detected in the circuit board;

a management processor; and a fault warning circuit coupled to the circuit board and the management processor comprising;

a first light emitting diode (LED), a pull-up circuit coupled to the first LED to bias an anode of the first LED to an upper supply, a pull-down circuit coupled to the first LED to bias a cathode of the first LED to a lower supply, the pull-down circuit includes a first transistor coupled in series with the first LED and a second transistor electrically coupled to the first transistor to selectively activate the first transistor in response to a signal provided by the circuit board, and an output transistor coupled to the management processor, wherein the second transistor is electrically coupled to the output transistor to selectively activate the third transistor in response to the signal provided by the circuit board.

5. The communication system of claim 4 further comprising a third transistor coupled in series with the first LED, and parallel to the first transistor, to control operation of the LED in response to a non-fatal fault signal provided by the circuit board.

6. The communication system of claim 4 further comprising a second LED coupled to be illuminated when the first transistor is inactive.

7. A circuit board fault indicator comprising:

a first light emitting diode (LED) having an anode coupled to an upper supply voltage node via a first resistor, a first transistor coupled between a cathode of the first LED and a lower supply voltage node;

a second transistor electrically coupled to a control node of the first transistor to selectively activate the first transistor in response to a signal provided by an external circuit board;

a third transistor coupled between the cathode of the first LED and the lower supply voltage node, a control node of the third transistor is coupled to receive a non-fatal fault signal provided by the external telecommunication circuit board;

an output transistor coupled between a signal output node and the lower supply voltage node, a second LED coupled to be illuminated when the first transistor is inactive.

8. The circuit board fault indicator of claim 7 wherein the first, second, third and output transistors are NPN transistors.

9. A method of indicating faults in a communication system comprising:

monitoring an operational status of a circuit;

activating a first light emitting diode (LED) and deactivating a second LED if the operational status of the circuit is non-functional; and wherein activating a first LED and deactivating a second LED comprises turning off a pull-down transistor in response to a "deadman" signal from the circuit, wherein the pull-down transistor is electrically coupled to a control node of an LED a transistor coupled in series with the first LED.

activating the first LED while the second LED remains active if the operational status of the circuit is a functional fault.

10. The method of claim 9 wherein activating a first LED while the second LED remains active comprises activating a transistor coupled in series with the first LED in response to a non-fatal fault signal from the circuit.

11. A fault warning circuit comprising:

a first light emitting diode (LED);

a resistor coupled to an anode of the first LED to bias the anode of the first LED to an upper supply;

a first NPN transistor coupled between a cathode of the first LED and a lower power supply;

a second NPN transistor electrically coupled to a base of the first NPN transistor, a base of the second NPN transistor receives a signal provided by an external circuit; and an output NPN transistor to provide an output signal, wherein the second NPN transistor is electrically coupled to a base of the output NPN transistor to selectively activate the output NPN transistor in response to the signal provided by the circuit board.

12. The fault warning circuit of claim 11 further comprising a second LED having an anode coupled to a bias resistor and a cathode coupled to a collector of the second NPN transistor.

13. A circuit board limit indicator comprising:

a light emitting diode (LED) having an anode coupled to an upper supply voltage node via a first resistor;

a first transistor coupled between a cathode of the LED and a lower supply voltage node;

a second transistor electrically coupled to a control node of the first transistor to selectively activate the first transistor in response to a signal provided by an external circuit board;

a third transistor coupled between the cathode of the LED and the lower supply voltage node, a control node of the third transistor is coupled to receive a non-fatal fault signal provided by the external telecommunication circuit board; and an output transistor coupled between a signal output node and the lower supply voltage node.

* * * * *